US009850577B1

(12) United States Patent
Huang

(10) Patent No.: US 9,850,577 B1
(45) Date of Patent: Dec. 26, 2017

(54) METAL PLATING APPARATUS FOR PLATING METAL WITH ZINC

(71) Applicant: TFD TECHNOLOGY CO., LTD., Kaohsiung (TW)

(72) Inventor: Chun-Chieh Huang, Kaohsiung (TW)

(73) Assignee: TFD TECHNOLOGY CO., LTD., Kaohsiung (TW)

( * ) Notice: Subject to any disclaimer, the term of this patent is extended or adjusted under 35 U.S.C. 154(b) by 0 days.

(21) Appl. No.: 15/227,781

(22) Filed: Aug. 3, 2016

(51) Int. Cl.

| | |
|---|---|
| ***B05C 3/04*** | (2006.01) |
| ***B05C 3/09*** | (2006.01) |
| ***C23C 18/16*** | (2006.01) |
| ***C23C 18/54*** | (2006.01) |
| ***B05C 3/08*** | (2006.01) |

(Continued)

(52) U.S. Cl.
CPC ..... *C23C 18/1628* (2013.01); *B05C 3/08* (2013.01); *B05C 3/09* (2013.01); *C23C 18/1619* (2013.01); *C23C 18/54* (2013.01); *C25D 17/16* (2013.01); *C25D 17/18* (2013.01); *C25D 17/20* (2013.01); *C25D 17/22* (2013.01); *C25D 17/24* (2013.01)

(58) Field of Classification Search
CPC ..... B05C 3/98; B05C 3/09; C23C 18/1628; C23C 18/1619; C23C 18/54; B28C 5/0862; B28C 7/16; B01F 15/00564; C25D 17/18; C25D 17/24; C25D 17/22; C25D 17/20; C25D 17/16
USPC ..... 118/418, 19; 366/235, 55, 49, 186; 204/201, 213, 214, 205
See application file for complete search history.

(56) References Cited

U.S. PATENT DOCUMENTS 2,386,319 A * 10/1945 Johnson ..... G01N 25/18 219/50
3,038,851 A * 6/1962 Jackson ..... C25D 17/20 204/213

(Continued)

FOREIGN PATENT DOCUMENTS

CN 103447199 A 12/2013
CN 103464042 A 12/2013

(Continued)

OTHER PUBLICATIONS

Author Unknown, "Mechanical Galvanizing: New Way to Bulk Coat Parts," Machine Design, vol. 52, No. 20, Sep. 1980, p. 12.

(Continued)

*Primary Examiner* — Laura Edwards
(74) *Attorney, Agent, or Firm* — Birch, Stewart, Kolasch & Birch, LLP

(57) ABSTRACT

A metal plating apparatus for plating metal with zinc is provided with a rotating device and a plurality of stirring devices. The rotating device has a driving assembly and a rotating assembly. The driving assembly has a driving gear. The rotating assembly is connected with and controlled by the driving assembly. The rotating assembly has a sustaining pillar. A rotating seat is mounted on the sustaining pillar and engaged with the driving gear. The stirring devices is mounted on the rotating seat radially and spaced from each other. The metal plating apparatus improves productivity through an automatic process which shifts locations of the stirring devices by the rotating device and plates metal with a cooperation of peripheral supporting apparatus, and improves working efficiency through decreasing occupied space and the number of operating personnel.

5 Claims, 4 Drawing Sheets

(51) Int. Cl.

| | |
|---|---|
| *C25D 17/18* | (2006.01) |
| *C25D 17/22* | (2006.01) |
| *C25D 17/24* | (2006.01) |
| *C25D 17/20* | (2006.01) |
| *C25D 17/16* | (2006.01) |

(56) References Cited

U.S. PATENT DOCUMENTS

| | | | | |
|---|---|---|---|---|
| 3,442,691 | A | 5/1969 | Pearson | |
| 4,616,593 | A * | 10/1986 | Kawamura | B05B 12/1472 118/303 |
| 6,837,933 | B2 * | 1/2005 | Reinhardt | B05C 3/08 118/418 |

FOREIGN PATENT DOCUMENTS

| | | | |
|---|---|---|---|
| CN | 203402622 | U | 1/2014 |
| CN | 203703015 | U | 7/2014 |

OTHER PUBLICATIONS

Extended European Search Report issued in European Application No. 16182758.9 dated Jan. 26, 2017.

* cited by examiner

METAL PLATING APPARATUS FOR PLATING METAL WITH ZINC

BACKGROUND OF THE INVENTION

1. Field of the Invention

The present invention relates to a metal plating apparatus for plating metal with zinc, especially to a metal plating apparatus for plating metal with zinc that improves working efficiency.

2. Description of the Prior Arts

Most of small size metal parts, such as screws, are made of iron, so the metal parts are prone to rust. In order to prevent rusting and improve antioxidant capacity, the metal parts may undergo a surface plating treatment with zinc for forming a protection layer on surfaces of the metal parts. The surface plating treatment with zinc is performed with a horizontal rotating device mounted with a stirring device, and the stirring device cooperates with a feeding conveyor and an unloading conveyor disposed on an outer periphery of the stirring device. The metal parts enter a barrel of the stirring device through the feeding conveyor. The stirring device is capable of adjusting an elevation angle of the barrel and rolling the barrel so that the metal parts are plated with zinc. During the plating, different chemicals are added. The horizontal rotating device is capable of turning the stirring device and adjusting an orientation of the barrel to let other auxiliary devices add the chemicals into the barrel. After finishing plating metal parts with zinc in the barrel, the horizontal rotating device turns the stirring device to orient to the unloading conveyor, and the stirring device adjusts the elevation angle of the barrel so that the metal parts in the barrel can be poured to the unloading conveyor.

However, each stirring device needs to cooperate with one horizontal rotating device. Besides, each one of a feeding conveyor, an unloading conveyor and an auxiliary device for adding chemicals cooperates with a respective stirring device individually. To improve production capacity by increasing the number of the stirring device, numbers of the horizontal rotating device, the auxiliary device, the feeding conveyor and the unloading conveyor are also increased. Thus, the whole apparatus occupy huge space and needs more manpower to operate, which decreases the working efficiency.

To overcome the shortcomings, the present invention provides a metal plating apparatus for plating metal with zinc to mitigate or obviate the aforementioned problems.

SUMMARY OF THE INVENTION

The main objective of the present invention is to provide a metal plating apparatus for plating metal with zinc which overcomes the shortcomings of the conventional plating apparatus that occupies huge space and needs a lot of people to operate for improving productivity but decrease working efficiency, because one stirring device needs to cooperate with one horizontal rotating device, and each one of a feeding conveyor, an unloading conveyor and an auxiliary device cooperates with one respective stirring device individually.

The metal plating apparatus for plating metal with zinc has a rotating device including a driving assembly comprising a driving gear, a rotating assembly connected with and controlled by the driving assembly, and the rotating assembly including a sustaining pillar, and a rotating seat mounted on the sustaining pillar and engaged with the driving gear; and a plurality of stirring devices mounted on the rotating seat radially and spaced apart from each other.

Then, an outer periphery of the metal plating apparatus is disposed with a feeding device, an unloading device and a pouring auxiliary device. The rotating seat of the rotating device turns the stirring devices so that the stirring devices can shift position according to different working processes through the rotating device. Thus, the stirring devices on the rotating seat are capable of cooperating with the feeding device, the unloading device and the pouring auxiliary device, and plating metal parts with zinc automatically. So the metal plating apparatus improves both productivity and working efficiency, and decreases occupying space and the number of operating personnel.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
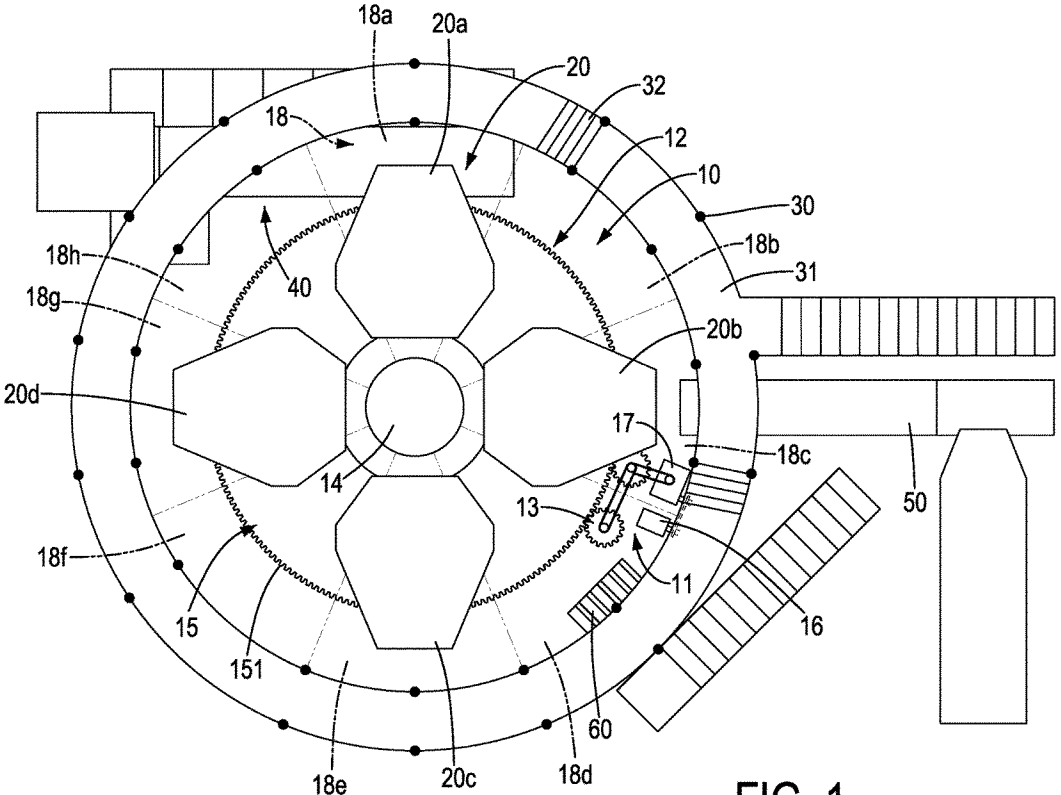
FIG. 1 is a plan view of a metal plating apparatus for plating metal with zinc in accordance with the present invention.
Figure 2:
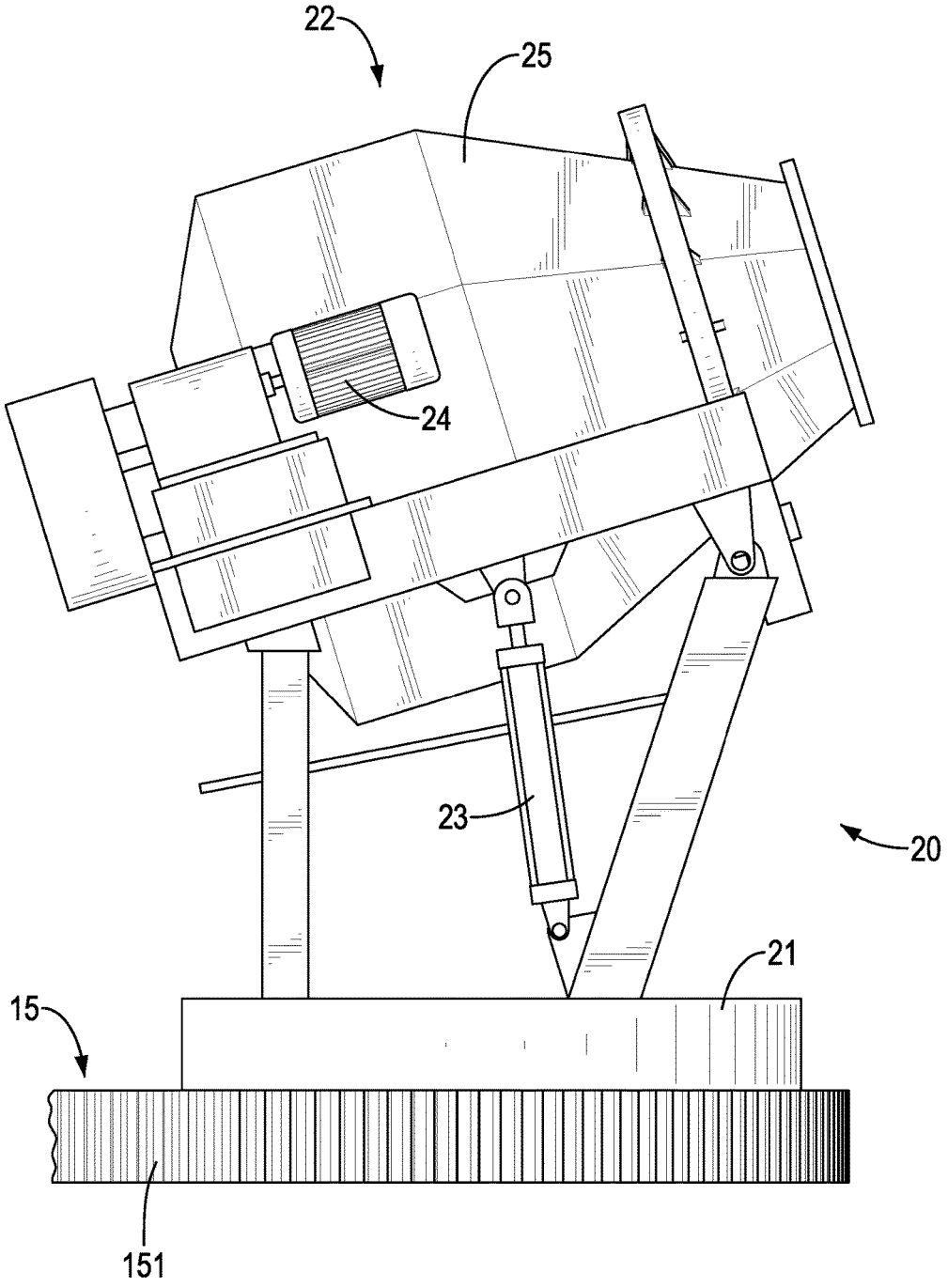
FIG. 2 is a side view of the metal plating apparatus in FIG. 1.

With reference to FIGS. 1 and 2, one preferred embodiment of a metal plating apparatus for plating metal with zinc in accordance with the present invention is provided including a rotating device 10 and a plurality of stirring devices 20.

Figure 3:
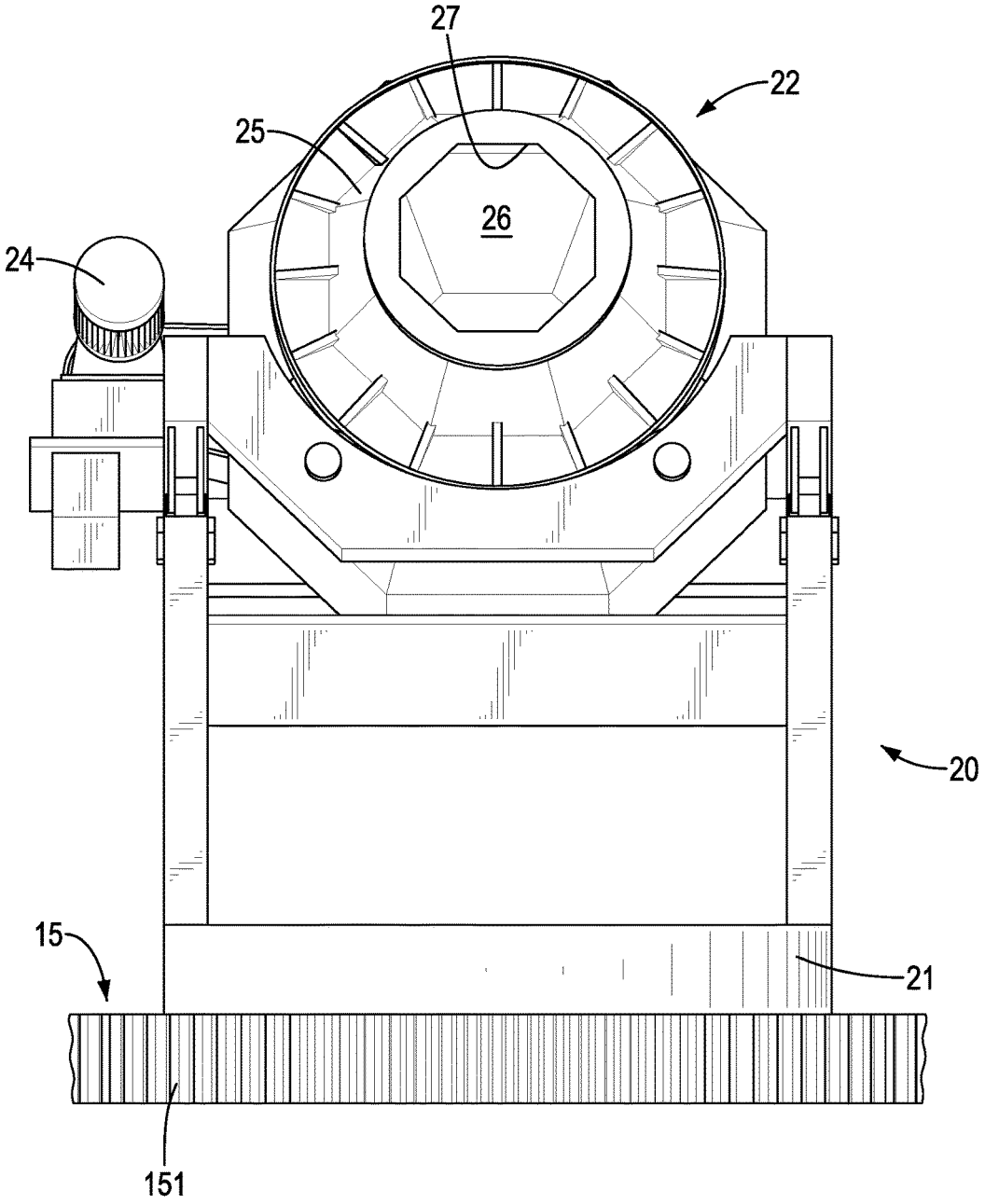
FIG. 3 is a front view of the metal plating apparatus in FIG. 1.

The rotating device 10 includes a driving assembly 11 and a rotating assembly 12. The driving assembly 11 comprises a driving gear 13. The rotating assembly 12 is connected with and controlled by the driving assembly 11. The rotating assembly 12 includes a sustaining pillar 14, and the sustaining pillar 14 is mounted with a rotating seat 15 thereon. The rotating seat 15 is engaged with the driving gear 13. The rotating seat 15 is divided into a plurality of radial working areas 18, and each one of the working areas 18 is disposed with a sensor (not illustrated in the drawings) for detecting a location of the stirring device 20 that is mounted on the rotating seat 15. The driving assembly 11 comprises a motor 16, the motor 16 is connected with a reducer 17, and the reducer 17 is connected with the driving gear 13. The rotating seat 15 includes a tooth portion 151 at an outer surface of the rotating seat 15, and the tooth portion 151 engages with the driving gear 13. The rotating device 10 can adopt 360-degree-rotation power supply with an electric rail. The stirring devices 20 are mounted radially on the rotating seat 15 of the rotating device 10, and the stirring devices 20 are spaced apart from each other. In accordance with FIGS. 2 and 3, each one of the stirring devices 20 includes a base 21, a barrel assembly 22, an elevation angle adjusting element 23 and a barrel rotating element 24. The base 21 is mounted securely on the rotating seat 15. The barrel assembly 22 is mounted on the base 21 and includes a barrel 25. The barrel 25 forms an accommodating space 26 and an opening 27. The accommodating space 26 is inside the barrel 25, and the opening 27 is at an outer surface of the barrel 25. The opening 27 communicates with the accommodating space 26. The elevation angle adjusting element 23 is mounted on the base 21, and a top end of the elevation angle adjusting element 23 is connected with the barrel assembly 22. The barrel rotating element 24 is mounted on the base 21, and the barrel rotating element 24 is connected with and drives the barrel assembly 22.

The metal plating apparatus includes a plurality of erect pillars 30 and a viewing platform 31. The erect pillars 30 are mounted around and surround the rotating assembly 12, and the erect pillars 30 are spaced apart from each other. The viewing platform 31 is mounted on the erect pillars 30 and spaced apart from an outer periphery of the rotating seat 15. At least one flight of stairs 32 is disposed on the viewing platform 31.

According to FIG. 1, the rotating seat 15 of the metal plating apparatus is divided into eight working areas 18, which sequentially are a first working area 18*a*, a second working area 18*b*, a third working area 18*c*, a fourth working area 18*d*, a fifth working area 18*e*, a sixth working area 18*f*, a seven working area 18*g* and an eighth working area 18*h*. The metal plating apparatus comprises four stirring devices 20 mounted on the rotating seat 15.

Figure 4:
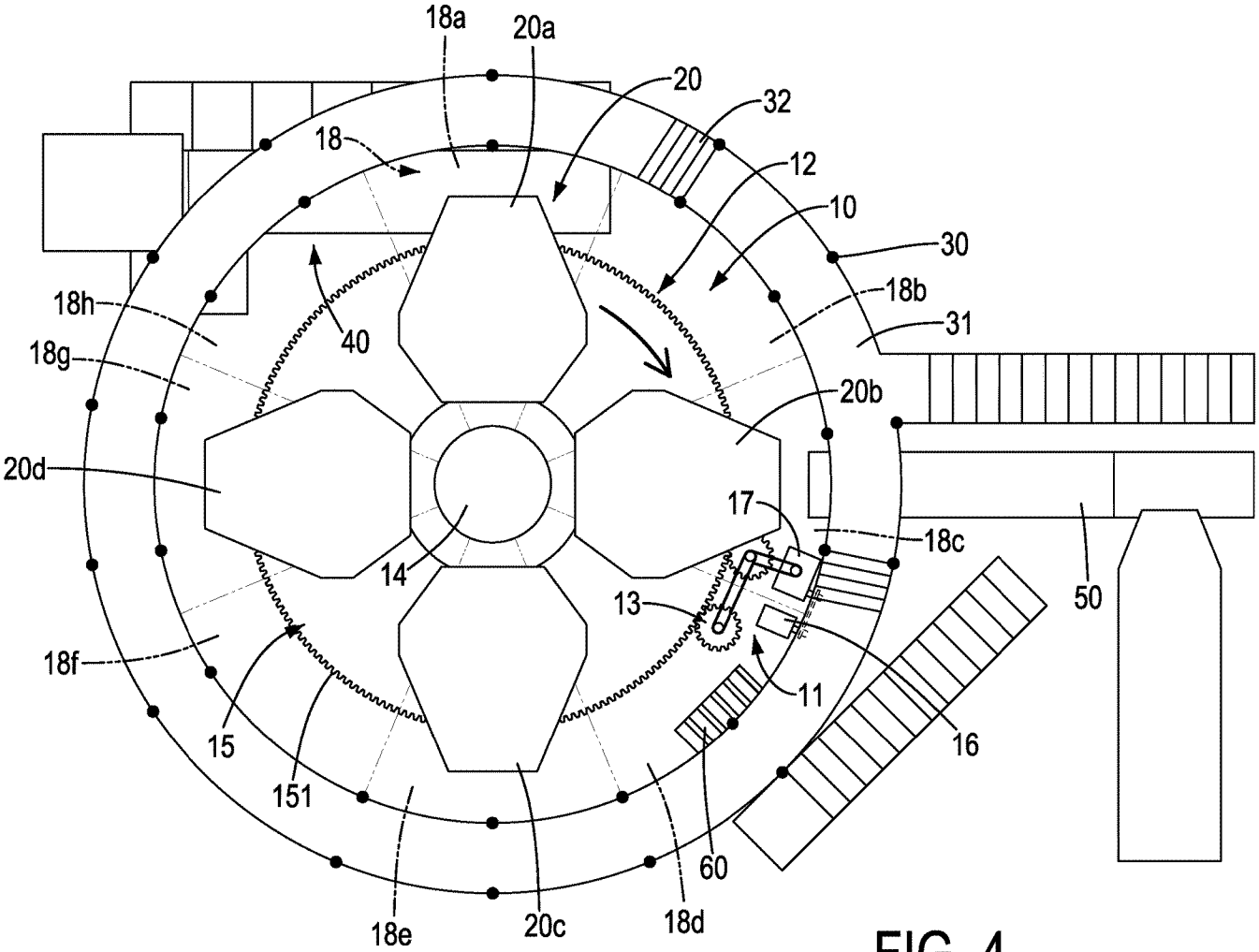
FIG. 4 is an operational schematic view of the metal plating apparatus in FIG. 1.

With reference to FIGS. 1 and 4, an outer periphery of the metal plating apparatus may be disposed with a peripheral supporting apparatus comprising an unloading device 40 disposed adjacent to the first working area 18*a*, a feeding device 50 disposed adjacent to the third working area 18*c* and a pouring auxiliary device 60 disposed adjacent to the fourth working area 18*d*. The unloading device 40 comprises an unloading conveyor and an unloading shaking table. The feeding device 50 comprises a feeding conveyor and a feeding shaking table. Then refer to FIG. 4, the four stirring devices 20 are divided into a first stirring device 20*a*, a second stirring device 20*b*, a third stirring device 20*c* and a fourth stirring device 20*d*. When the first stirring device 20*a* is located at the first working area 18*a*, the second stirring device 20*b* is located at the third working area 18*c*, the third stirring device 20*c* is located at the fifth working area 18*e* and the fourth stirring device 20*d* is located at the seventh working area 18*g*.

The first working area 18*a* of the metal plating apparatus performs an unloading task with a cooperation of the unloading device 40; the second working area 18*b* performs a bead pouring task with a cooperation of a water-bead tank; the third working area 18*c* performs a screw feeding task with a cooperation of the feeding device 50; the fourth working area 18*d* performs a pouring task of pouring initiator, hydrochloric acid, copper powder and stannous chloride with a cooperation of the pouring auxiliary device 60; the fifth working area 18*e*, the sixth working area 18*f* and the seventh working area 18*g* perform a zinc powder titration task with a cooperation of a zinc powder titration pump; and the eighth working area 18*h* performs a washing task with a cooperation of a washing device. The beads are used as a medium, and diameters of the beads that are poured into the barrel 25 are different from each other. The hydrochloric acid is used for cleaning surfaces of the screws and promoting plating effect.

In accordance with FIG. 4, when the first stirring device 20*a* is located at the first working area 18*a*, the first stirring device 20*a* performs an unloading action with a cooperation of the unloading device 40. At the meantime, the second stirring device 20*b* is located at the third working area 18*c* and performs a feeding action with a cooperation of the feeding device 50; the third stirring device 20*c* is located at the fifth working area 18*c* and performs the zinc powder titration task; and the fourth stirring device 20*d* is located at the seventh working area 18*g* and performs the zinc powder titration task.

After the stirring devices 20 accomplish the tasks at the working areas 18, the driving assembly 11 can work and drive the rotating seat 15 of the rotating assembly 12 so that the stirring devices 20 are shifted to the next working areas 18. In other words, the first stirring device 20*a* is shifted to the second working area 18*b* and performs the bead pouring task, the second stirring device 20*b* is shifted to the fourth working area 18*d* and performs the pouring tasks of pouring initiator, hydrochloric acid, copper powder and stannous chloride, the third stirring device 20*c* is shifted to the sixth working area 18*f* and performs the zinc powder titration task, and the fourth stirring device 20*d* is shifted to the eighth working area 18*h* and performs the washing task. After the sensor detects the stirring devices 20 on the rotating seat 15 are at a right location, the driving assembly 11 stops turning the rotating seat 15. When the tasks are finished, the driving assembly 11 turns the rotating seat 15 again. Time duration of each one of the stirring devices 20 staying at the working area 18 is approximately twelve minutes.

The elevation angle adjusting element 23 of each one of the stirring devices 20 is used for adjusting an elevation angle of the barrel 25 to suit with different tasks. The barrel rotating element 24 can roll the barrel 25 to mix the beads, the screws, the initiator and the zinc powder which are poured into the barrel 25. Besides, the operators can walk onto the viewing platform 31 to check the operation in the barrel assembly 22.

Consequently, the metal plating apparatus for plating metal with zinc comprises the stirring devices 20 mounted on the rotating seat 15 and the driving assembly 11 to rotate the rotating seat 15, shifting the locations of the stirring device 20 to cooperate with the peripheral supporting apparatus. Thus, the present metal plating apparatus does not need to dispose a horizontal rotating device under each one of the stirring devices 20, but allows each one of the stirring devices 20 to cooperate with the peripheral supporting apparatus alternately. Therefore, the present metal plating apparatus improves both productivity and working efficiency by decreasing occupied space and the number of operating personnel, and providing an automatic process.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A metal plating apparatus for plating metal with zinc, the metal plating apparatus including:

a rotating device including a driving assembly comprising a driving gear, a rotating assembly connected with and controlled by the driving assembly, and the rotating assembly including a sustaining pillar, and a rotating seat mounted on the sustaining pillar and engaged with the driving gear, and thereby the rotating seat rotated by the driving assembly; and a plurality of stirring devices mounted on the rotating seat radially and spaced apart from each other, each one of the stirring devices including:

a base mounted securely on the rotating seat;

a barrel assembly mounted on the base and including:

a barrel forming an accommodating space inside the barrel; and an opening at an outer surface of the barrel, the opening communicating with the accommodating space for plating metal with zinc;

an elevation angle adjusting element mounted on the base, and a top end of the elevation angle adjusting element connected with the barrel assembly; and a barrel rotating element mounted on the base, and connected with and driving the barrel assembly.

2. The metal plating apparatus as claimed in claim 1, wherein the rotating seat is divided into a plurality of working areas disposed radially, and each one of the working areas is disposed with a sensor for detecting whether the stirring device mounted on the rotating seat is at a right location.

3. The metal plating apparatus as claimed in claim 2, wherein the rotating seat is divided into a first working area, a second working area, a third working area, a fourth working area, a fifth working area, a sixth working area, a seventh working area and an eighth working area.

4. The metal plating apparatus as claimed in claim 1, wherein a number of the stirring devices is four.

5. The metal plating apparatus as claimed in claim 1, wherein the driving assembly includes a motor;

a reducer connected with the motor and connected with the driving gear; and the rotating seat includes a tooth portion at an outer surface of the rotating seat; the tooth portion is engaged with the driving gear.

* * * * *